United States Patent [19]

Wagner

[11] Patent Number: 4,991,712

[45] Date of Patent: Feb. 12, 1991

[54] DESK ORGANIZER

[75] Inventor: Michael J. Wagner, Carol Stream, Ill.

[73] Assignee: Sanford Corporation, Bellwood, Ill.

[21] Appl. No.: 418,652

[22] Filed: Oct. 10, 1989

[51] Int. Cl.[5] ..... A45C 11/34

[52] U.S. Cl. ..... 206/214; 206/371; 206/561; 206/564; D9/347; D7/38

[58] Field of Search ..... 206/44.11, 45, 214, 206/224, 371, 561, 562, 563, 564; 248/146; D9/341, 347, 430, 431; D19/9; D7/38

[56] References Cited

U.S. PATENT DOCUMENTS

| | | | |
|---|---|---|---|
| D. 88,167 | 11/1932 | Nereim | 206/45 |
| D. 261,583 | 11/1981 | Labasan | D7/38 |
| D. 268,157 | 3/1983 | Campton | D7/38 |
| D. 280,741 | 9/1985 | Chatham | D9/347 |
| D, 288,012 | 1/1987 | Sussman | D9/347 |
| 1,109,561 | 9/1914 | Williamson | 206/45 |
| 3,499,540 | 3/1970 | Huncovsky | D9/347 |
| 4,406,368 | 9/1983 | Hermes | 206/371 |
| 4,501,358 | 2/1985 | Zinbarg | 206/371 |
| 4,579,399 | 4/1986 | Poltash | 211/163 |
| 4,700,829 | 10/1987 | Goodyear | 206/214 |
| 4,753,341 | 6/1988 | McIntyre | 206/45 |
| 4,807,760 | 2/1989 | Sussman | 206/371 |

FOREIGN PATENT DOCUMENTS

| | | | |
|---|---|---|---|
| 2381634 | 10/1978 | France | 206/214 |

*Primary Examiner*—David T. Fidei

*Attorney, Agent, or Firm*—Richard Bushnell

[57] ABSTRACT

A desk organizer for office supplies including first and second sidewalls joined at their common ends and an endwall connecting opposite ends of the first and second sidewall. The desk organizer also includes a bottom wall and means for dividing the organizer into a plurality of successive bins.

4 Claims, 2 Drawing Sheets

DESK ORGANIZER

The present invention relates to a desk organizer and more specifically to a novel desk organizer which has a triangular shape and a plurality of successive bins or receptacles for envelopes, pads of paper, pens and pencils or the like.

At the present time, there are many different types of desk organizers or containers for holding various stationary supplies such as writing instruments, pads of paper, envelopes, paper clips or the like. Often, these containers are designed to hold one or two items. Thus, the user will have a variety of different types of containers in various shapes and sizes to hold particular items. The use of multiple containers can reduce the amount of usable work space on a desk.

As previously indicated, there are some desk organizers which include separate sections or means for retaining different items such as envelopes of various sizes, writing instruments, paper clips or pads of paper, etc. However, if each section is on the same plane or level, then the items placed in the first section or forward section may block the view of the items in subsequent sections.

At the present time, modular desk units are very popular in offices. Such units include a desk and is surrounded by movable walls. Thus, a desk organizer configured to fit snuggly in the corner of a desk would not fall off the desk because it would be surrounded by walls and would increase the usable desk space.

Accordingly, a general object of the present invention is to provide a novel desk organizer that is configured to fit in the corner of a modular desk unit. A further object of the present invention is to provide a novel desk organizer which is easy and economical to manufacture.

A more specific object of the present invention is to provide a novel desk organizer which includes means for dividing the organizer into successive bins for retaining stationary items such has writing instruments, pads of paper, envelopes, paper clips or the like, at least one bin having raised bottom section or other means for enabling successive bins to present articles such as envelopes stored therein at different levels for ready access.

A further object of the present invention is to provide a novel desk organizer, which includes a tray section for retaining paper clips and the like, which has a curved bottom wall portion which enables the user to easily remove the paper clips from the section.

SUMMARY OF THE INVENTION

A desk organizer for storing stationary items such as writing instruments, pads of paper, envelopes and paper clips or the like. The desk organizer includes a first and second sidewall joined together at their common ends, an end wall connecting opposite ends of the first and second sidewalls, a bottom wall and means for dividing the desk organizer into a plurality of successive bins.

BRIEF DESCRIPTION OF THE DRAWINGS

Features of the present invention which are believed to be novel are set forth with particularity in the appended claims.

The organization and manner of operation of the invention, together with further objects and advantages thereof, can best be understood by reference to the following description taken in connection with the accompanying drawings in which.

DETAILED DESCRIPTION OF THE ILLUSTRATED EMBODIMENT

Figure 1:
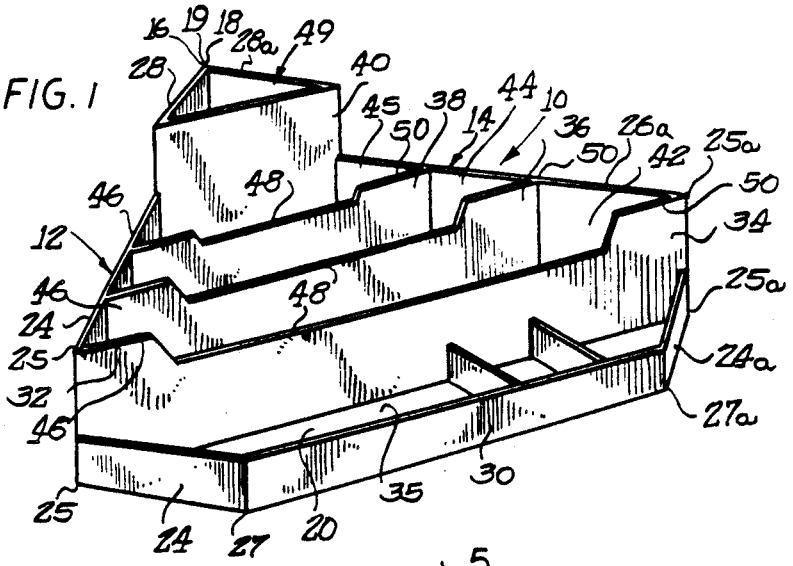
FIG. 1 is a perspective view showing a desk organizer incorporating features of the present invention.

Turning now to the drawings, and initially to FIG. 1, a desk organizer constructed in accordance with the present invention is indicated generally by reference numeral 10.

The desk organizer 10 has as a substantially triangular shape and is preferably made of a one piece molded plastic material or the like. As shown best in FIGS. 1 and 3, the desk organizer 10 vertically upstanding sidewall 14. Sidewalls 12 and 14 have common ends 16 and 18 respectively which are molded or otherwise joined together forming a substantially 45 degree angle or corner at 19.

The desk organizer 10 also includes a horizontally extending bottom wall or member 20 which is configured to cover the bottom area of the entire desk organizer. The bottom wall 20 will be discussed further below.

A plurality of feet 22 extend from the bottom wall 20 as shown best in FIGS. 2, 4, 5 and 6.

First and second sidewalls 12 and 14 are substantially identical to each other and include first sections 24 and **24*a* respectively, each having a predetermined vertical height; second or middle sections 26 and 26*a* respectively, each having a predetermined vertical height and third or end sections 28 and 28*a*** respectively, each having a third predetermined vertical height.

As shown best in FIGS. 1, 2, 4 and 5, the vertical height of first sections 24 and **24*a* is substantially less than the height of middle sections 26 and 26*a* of first and second sidewalls 12 and 14, respectively. In addition, the vertical height of end sections 28 and 28*a* is substantially greater than the vertical height of middle sections 26 and 26*a***.

Figure 2:
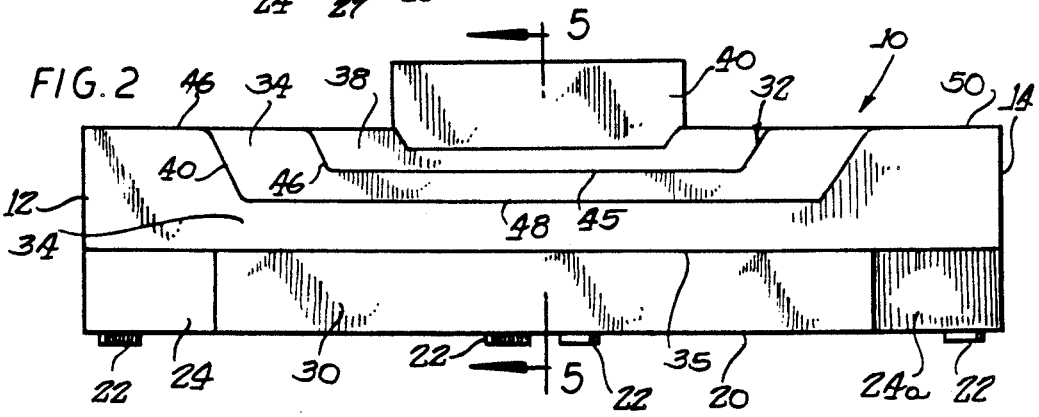
FIG. 2 is an enlarged front view of the desk organizer shown in FIG. 1.
Figure 3:
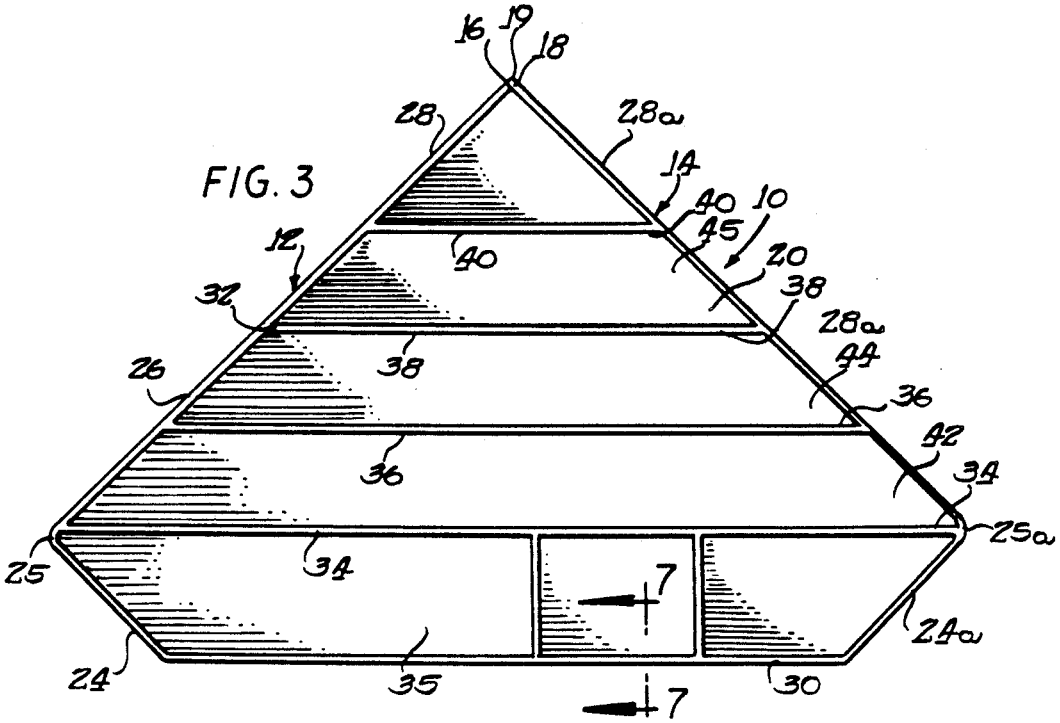
FIG. 3 is a top plan view of FIG. 1.
Figure 4:
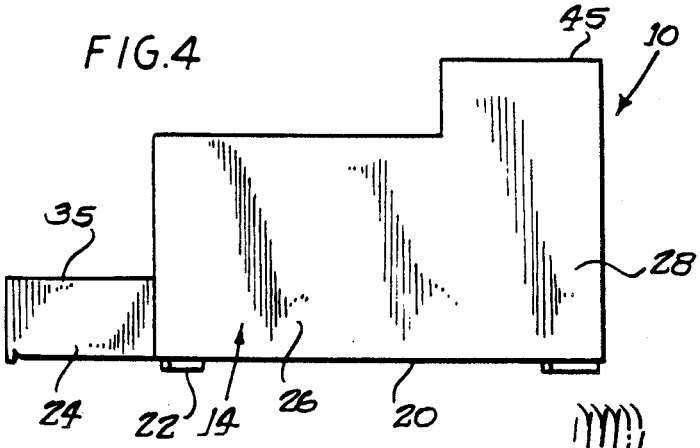
FIG. 4 is a side view of the left-hand side of FIG. 1, the right side being a mirror image thereof.

As shown best in FIGS. 1, 2, and 3 the middle sections 26, **26*a* and end sections 28, 28*a* are on substantially the same plane. However, at the points 25 and 25*a*, where first sections 24 and 24*a* terminate and middle sections 26 and 26*a* begin, first sections 24 and 24*a* bend or angle inwardly forming a substantially 45 degree angle. Thus, the distance between first sidewall 12 and second sidewall 14 gradually increases until points 25 and 25*a*** and then gradually decreases.

An end wall or base portion 30 connects the ends 27 and **27*a* of first sections 24 and 24*a* respectively. End wall 30 has a predetermined vertical height which is substantially the same as the vertical height of first sections 24 and 24*a* of sidewalls 12 and 14**.

Figure 5:
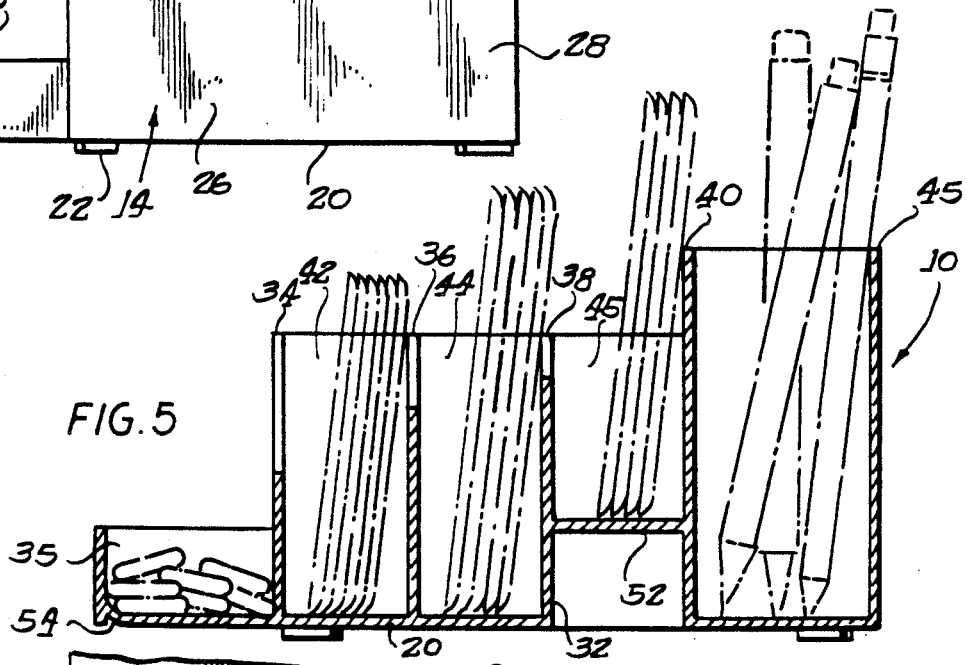
FIG. 5 is a sectional view taken along lines 5—5 of FIG. 2.
Figure 6:
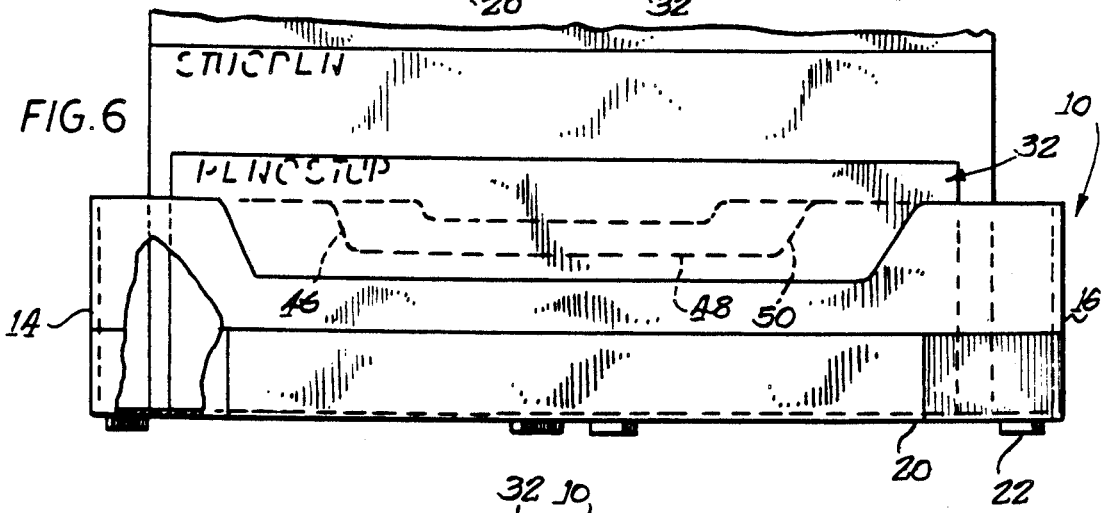
FIG. 6 is a partially broken away front view showing envelopes therein.
Figure 7:
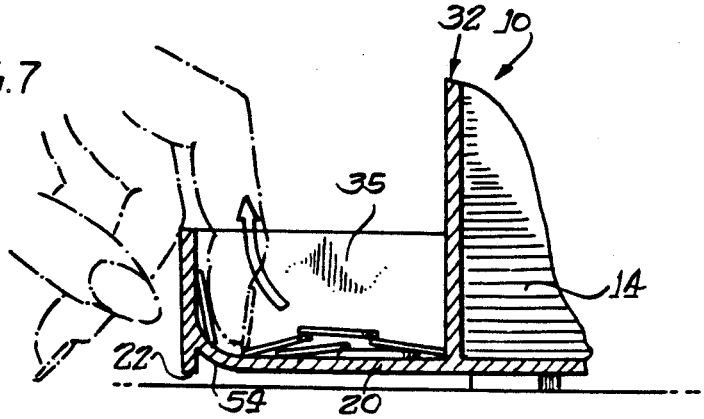
FIG. 7 is a sectional view taken along line 7—7 of FIG. 3.

In addition, the desk organizer 10 is provided with bin means 32 for separating or dividing the organizer 10 into a plurality of successive bins or receptacles for receiving a variety of stationary items such as writing instruments, envelopes, pads of paper, paper clips or the like as shown best in FIG. 5. As will be discussed below, the size or length of each bin is less than the bin in front of it. Thus, the bins are suitable for holding items having various shapes and sizes.

The divider or bin mans 32 include first, second, third and fourth vertically upstanding dividers or members 34, 36, 38 and 40 respectively. Although, the drawings show one embodiment of this invention with four dividers, it is understood that the number and location of the dividers can be altered.

As shown in FIG. 1, first divider 34 extends from the inside of first sidewall 12 at substantially point 25 where first and second sections 24 and 26 meet to substantially the same point 25a at second sidewall section 14.

A tray member 35 is defined by first sections 24 and 24a of sidewalls 12 and 14, divider 34 and end wall 30. The tray member 35 includes a pair of spaced apart tray dividers 37 and 39 which extend from divider 34 to end wall 30. Tray dividers 37 and 39 divide the tray 35 into sections so that various stationary items be placed into different or separate sections. It is understood, that the number and placement of the tray dividers can vary and, if desired, they may be made as separate pieces.

Second divider 36 also extends from the inside of first sidewall 12 at the predetermined point to the inside of second sidewall 14 approximately at the same point. First and second dividers 34 and 36 are spaced apart from each other to define a first bin or receptacle 42 for holding envelopes, writing pads, index cards or the like. As shown best in FIG. 1, the length of the second divider 36 is less than the length of the first divider 34.

Third divider 38 also extends from the inside of first sidewall 12 at a predetermined point to the inside of second sidewalk 14 at approximately the same point. Second divider 36 and third divider 38 define a second bin or receptacle 44. Again, the length of the third divider 38 is less than the length of the second divider 36 and the length of bin 44 is less than bin 46. Thus, as shown in FIG. 5, bin 44 may be used to hold envelopes or the like which are smaller than the items placed in bin 42.

The fourth divider 40 extends from approximately the point where middle section 26 terminates and end section 28 begins at the inside of sidewall 12 to the inside of sidewall 14 at approximately the same point. Fourth divider 40 and third divider 38 define a third bin or receptacle 45 which has a length less than the length of second bin 44.

In addition, as shown best in FIG. 5, the vertical height of divider 40 is substantially the same as the vertical height of end sections 28 and 28a of sidewalls 12 and 14. Divider 40, and end sections 28 and 28a define a substantially triangular pen and pencil cup 49. The height of end sections 28, 28a and divider 40 must be high enough to hold or retain writing instruments so that they do not fall out of the pencil cup 49.

As shown best in FIGS. 1, 2, 5 and 6 dividers 34, 36 and 38 include a first end section 46 a second end section 50 and a substantially U-shaped reduced portion or cutout section 48 therebetween. The vertical height of first and second end sections 46 and 50 are substantially the same as the vertical height of middle sections 26 and 26a of sidewalls 12 and 14. In addition, the tops of first and second sections 46 and 50 are on the same level as the tops of sections 26 and 26a of sidewalls 12 and 14. The vertical height of the reduced portion or cutout portion 48 is sufficiently less than the height of end section 48 and 50 to enhance the user's ability to clearly see and identify the various stationary items stored in each successive bin. However, the increased vertical height of end sections 46 and 50 will prevent the items from falling out of the bin.

As previously indicated, the bottom wall or member 20 extends from first sidewall 12 to second sidewall 14. The various items such as envelopes, pads of paper, pens and pencils and paper clips or the like rest on the top of bottom wall 20 as shown best in FIG. 5. In addition, as shown in FIG. 5, the bottom wall 20 includes an elevated horizontal portion 52 which extends from the third divider 38 to forth divider 40.

As shown best in FIG. 5, when a note pad or the like is placed in bin 45, the item rests on elevated portion 52. Thus, the items in bin 45 will be raised so that the user can view the items when the preceeding bins 42 or 44 are full.

In addition, the bottom member 20 curves or slopes into end wall 30 and section 24 and 24a to form a rounded peripheral surface 54. As shown best in FIGS. 5 and 6, this rounded edge will enable the user to easily retrieve paper clips or the like by sliding the clip or similar object with their finger tip up the inside portion of end wall 30 or sections 24 or 24a. This prevents the clips or the like from getting caught or stuck in the recess of the corner where the bottom wall 26 meets the first sections 24 and 24a and end member 30.

While particular embodiments of the invention have been shown and described in detail, it will be obvious to one skilled in the art that changes and modifications of the present invention, in its various aspects may be made without departing from the invention in its broader aspects.

I claim:

1. A desk organizer for containing a variety of stationary items made of one-piece molded plastic comprising vertically upstanding first and second angularly disposed and intersecting sidewalls, said first and second sidewalls being joined together at their common ends, a vertically upstanding end wall connecting opposite ends of said first and second sidewalls, a bottom wall covering the area between said first and second sidewalls and said end wall, and means for dividing said organizer into at least a first, middle and third successive bins for retaining said stationary items, said bottom wall having a raised portion for elevating the bottom of said middle bin, said first and second sidewalls including a first section having a predetermined height, a middle section having a predetermined height which is greater than the height of said first section and an end section having a predetermined height which is greater than the height of the middle section and height of the first section, said end wall having a predetermined vertical height which is substantially the same as the height of the first section of said first and second sidewalls defining a shallow front tray member, said bin means including at least a first, second and third vertically upstanding divider having predetermined vertical heights, said first divider extending from the inside of said first sidewall at approximately the point where said first section and second section of said first sidewall meet to the inside of said second sidewall at approximately the same point, said second divider being spaced from said first divider, said second divider extending from the inside of said first sidewall at a predetermined point to the inside of said second sidewall at approximately the same predetermined point, said third divider being spaced from said second divider and from the joined ends of said first and second sidewalls, said third divider extending from the inside of said first sidewall at approximately the point where said second section and said end section of said first sidewall meet to the inside of said second sidewall at approximately the same point, said third divider having substantially the same vertical height as said end sections of said first and second sidewalls, said first and second dividers defining said first bin, said second and third dividers defining said middle bin and said third divider and said joined ends of said first and second sidewalls defining said third bin for retaining writing instruments, said bottom wall curing into said first section of said first and second sidewalls and said end wall.

2. A desk organizer of claim 1 wherein said first divider member includes first and second end sections and a U-shaped section between said first and second end sections, said first and second end sections having a vertical height greater than the vertical height of said U-shaped section.

3. A desk organizer for holding stationary supplies, said desk organizer comprising upstanding first and second angularly disposed sidewalls joined together at first ends thereof, said first and second sidewalls including a first section having a predetermined height, a middle section angularly disposed to said first section and having a predetermined height which is greater than the height of said first section and an end section having a predetermined height which is greater than the height of said middle section, an upstanding end wall connecting opposite ends of said first and second sidewalls, and having a vertical height substantially the same as the vertical height of said first section of said first and second sidewall forming a shallow front tray member, a bottom member extending from said first sidewall to said second sidewall and said end wall, and curving into said first section of said first and second sidewalls and said end wall and means for dividing said desk organizer into at least three successive elongated discrete unobstructed bins for retaining stationary items, said bottom member having at least one raised portion for elevating the bottom of one of said bins said bin means including at least a first vertically upstanding divider which extends from the inside of said first sidewall at a predetermined point to the inside of said second sidewall at approximately the same point, a second vertically upstanding divider spaced from said first divider and extending from the inside of said first sidewall at a predetermined point to the inside of said second sidewall, and a third divider spaced from said second divider and extending from the inside of said first sidewall at approximately the point where said second section and said end section meet to the inside of said second sidewall at approximately the same point, said third divider having substantially the same vertical height as the height of said end sections of said first and second sidewalls for defining a substantially deep bin for holding writing instruments.

4. A desk organizer of claim 3, wherein one of said dividers includes first and second end sections and a substantially middle section between said first and second end sections, said first and second end sections being greater in vertical height than the vertical height of said middle section.

* * * * *